US005692462A

United States Patent [19]

Hackett

[11] Patent Number: 5,692,462

[45] Date of Patent: Dec. 2, 1997

[54] TRANSFER VALVE ASSEMBLY PROVIDING VARIABLE VALVE LASH

[75] Inventor: David E. Hackett, Washington, Ill.

[73] Assignee: Caterpillar Inc., Peoria, Ill.

[21] Appl. No.: 595,969

[22] Filed: Feb. 6, 1996

[51] Int. Cl.[6] ..... F02B 59/00

[52] U.S. Cl. ..... 123/42; 123/188.17; 123/90.47

[58] Field of Search ..... 123/188.1, 188.17, 123/79 R, 42, 90.47

[56] References Cited

U.S. PATENT DOCUMENTS

| | | | |
|---|---|---|---|
| 2,117,434 | 5/1938 | Krebs | 123/188.1 |
| 3,002,507 | 10/1961 | Bensinger et al. | 123/90.47 |
| 4,767,287 | 8/1988 | Marks | 123/42 |
| 5,456,219 | 10/1995 | Clarke | 123/42 |
| 5,522,358 | 6/1996 | Clarke | 123/79 R |

FOREIGN PATENT DOCUMENTS

| | | | |
|---|---|---|---|
| 4129637 | 3/1993 | Germany | 123/188.17 |
| 436852 | 4/1949 | Italy | 123/188.17 |

*Primary Examiner*—Erick R. Solis
*Attorney, Agent, or Firm*—David L. Polsey

[57] ABSTRACT

A valve assembly for use in a dual compression/dual expansion engine having an internal housing operating within an external housing, the valve assembly having a valve element operating in a valve guide secured to the internal housing with a valve spring provided to ensure proper closure of the valve element, and a valve train subassembly extending coaxially about the valve spring, the valve train subassembly operating slidingly in the external housing of engine in response to a valve actuation means, such that the valve element and the valve train subassembly operate independently when the valve actuation means is not actuating the valve element.

22 Claims, 2 Drawing Sheets

TRANSFER VALVE ASSEMBLY PROVIDING VARIABLE VALVE LASH

TECHNICAL FIELD

This invention generally pertains to valve apparatus for internal combustion engines, and more particularly to transfer valve assemblies for controlling flow to and from the combustion chamber in dual compression/dual expansion internal combustion engines.

BACKGROUND ART

There are numerous methods known in the prior art for providing valve controlled fluid flow in internal combustion engines, and particularly in piston-type engines. Typical piston-type internal combustion engines are provided with valves disposed in the cylinder head, know as valve-in-head, which permits both relatively simple assembly and operation. A mechanical actuator for operating a valve in such a typical valve-in-head assembly can be located at a fixed position relative to both the valve and the piston crankshaft to ensure proper timing of the valve.

The typical valve actuating means includes a cam rotating about an axis parallel to the axis of the engine crankshaft. The cam then acts to positively actuate the valve element during the appropriate degrees of rotation. Actuation may be either direct, with the cam surface acting directly on the valve element, or indirect, by way of a valve actuating train.

In a dual compression/dual expansion internal combustion engine, such as that disclosed in U.S. Pat. No. 5,456,219 the combustion chamber is disposed within an internal housing or body which oscillates within the external housing of the engine. In such engines it is necessary to provide one or more intake transfer valves to permit a controlled flow of air from the low pressure compression chamber to the combustion chamber and one or more exhaust transfer valves to permit a controlled flow of air from the combustion chamber to the low pressure expansion chamber. The intake transfer valves and the exhaust transfer valves must be disposed on the internal housing of the engine in order to control this flow to and from the combustion chamber. Because the internal housing of such an engine oscillates while the axes of the engine crankshafts remain fixed, the transfer valve assemblies are also in motion with respect to the axes of the engine crankshafts.

The transfer valve assemblies, moving with the internal housing, require a valve actuation means capable of compensating for the movement of the transfer valve assemblies while still causing proper actuation of the transfer valves themselves. A typical transfer valve actuation means employing a cam and actuating train experiences unacceptably high forces and accelerations in the dual compression/dual expansion engine, and is therefore relatively difficult to apply, with unacceptably high maintenance requirements. These factors increase the cost of both the manufacture and operation of such an engine.

Therefore, it is an object of the present invention to provide a transfer valve assembly which can be easily employed in a dual compression/dual expansion engine.

It is another object of the present invention to provide a transfer valve assembly as will compensate for the forces and accelerations generated by the movement of the internal housing of the dual compression/dual expansion engine.

It is another object of the present invention to provide a transfer valve assembly which is relatively inexpensive to manufacture.

It is yet another object of the present invention to provide such a transfer valve assembly as can be readily assembled in a dual compression/dual expansion engine.

It is a further object of the present invention to provide a transfer valve assembly as will operate reliably and require relatively little maintenance.

These and other objectives of the present invention will become apparent in the specification and claims that follow.

SUMMARY OF THE INVENTION

The subject invention is a transfer valve assembly for use in a dual compression/dual expansion engine, the transfer valve assembly having a variable valve lash to compensate for the movement of the internal housing of the engine.

DESCRIPTION OF THE PREFERRED EMBODIMENT

Figure 1:
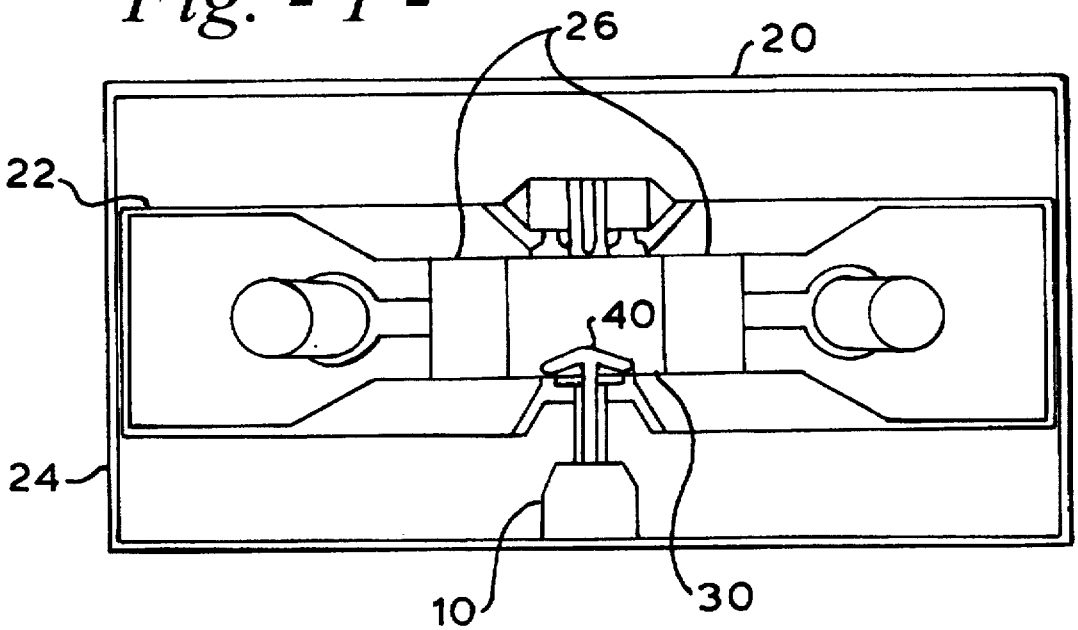
FIG. 1 shows in cross-sectional view a typical dual compression/dual expansion engine having an internal housing acting as a low pressure piston and including a transfer valve assembly according to the subject invention.

A valve assembly having variable valve lash generally according to the present invention is shown in FIG. 1 and referred to with reference number 10. The valve assembly 10 is shown as it is preferably employed as a transfer valve assembly 10 in an engine 20. For purposes of description herein, a representative dual combustion/dual expansion internal combustion engine is described, although the engine does not itself constitute any part of the subject invention. As an aid to understanding the drawings and description herein, the terms "upper", "lower", "right", "left", and other directional or positional references are to be understood as referring to the relative positions in the drawing Figures, and not to the subject invention as it may be employed in practice.

The engine 20 includes an internal housing 22 operating in a void defined in an external housing 24. Two pistons 26 are disposed in a void in the internal housing 22 defined by a combustion chamber wall 30, with the pistons 26 and the combustion chamber wall 30 defining the combustion chamber of the engine 20. In such an application the transfer valve assembly 10 is disposed on the internal housing 22 of the engine 20, communicating through an aperture defined by a generally cylindrical exhaust valve port surface 28 in the internal housing 22 to selectively permit and prevent flow communication from the combustion chamber.

For simplicity of description, the transfer valve assembly 10 is described herein as an exhaust transfer valve assembly. Those skilled in the relevant art will understand that the engine 20 could also employ one or more intake transfer valve assemblies, not described herein. In an intake valve application, the transfer valve assembly 10 would operate to selectively permit and prevent flow communication to the combustion chamber.

Turning to FIG. 1, the transfer valve assembly 10 can be seen in greater detail. The transfer valve assembly 10 includes a valve element 40 having a substantially cylindrical valve stem 42 and a planar, disk-type valve head 44. An annular valve seat 46 is provided in the exhaust port surface 28. When the transfer valve assembly 10 is in a closed, flow preventing position, the valve head 44 rests sealingly against the valve seat 46. Flow through the transfer valve assembly 10 is permitted when the valve element 40 is moved and spaced apart from the valve seat 46.

A guide support bridge 48 is provided in the internal housing, extending across the exhaust aperture in the internal housing 22. The guide support bridge 48 includes a generally cylindrical guide aperture 50 defining an aperture through which the valve stem 42 extends co-axially. A substantially tubular valve guide 52 slidingly engages at least a portion of the valve stem 42, with the valve stem extending through the valve guide inner surface 54 for directing the motion of the valve element 40 in a linear, co-axial direction of operation. The inner diameter of the valve guide 52 is sufficiently close fitting to the valve stem 42 diameter so as to linearly guide the valve element 40 within a permissible range of axial mis-alignment during relative movement between the valve element 40 and the valve guide 52. To ensure that the valve guide 52 remains in its preferred position relative to the interior housing 22, the valve guide anterior end 56 of the valve guide outer surface 58 is secured to the guide aperture 50 of the guide support bridge 48. Preferably, the valve guide 52 is retained in the guide aperture 50 by an interference press-fit between the guide aperture 50 and the valve guide outer surface 54, although other means of securing therebetween may be employed, such as with welding or mutually engaging threads.

At the valve guide distal end 60 an annular valve spring first support collar 62 is secured to the valve guide outer surface 58. As with the guide aperture 50, the valve guide outer surface 58 is preferably secured to the first support collar 62 by an interference press-fit therebetween, although other means of securing therebetween may be employed, such as with welding or mutually engaging threads.

The valve spring 68 engages a valve spring second support collar 74. The valve spring second support collar 74 extends annularly about the valve stem distal end 76 and is secured thereto such that the second support collar 74 and the valve stem distal end 76 move together relative to the valve guide 52 and the first support collar 62. Again, the second support collar 74 is preferably secured to the valve stem distal end 76 by an interference press-fit therebetween, although other means of securing therebetween may be employed, such as with welding or mutually engaging threads. The valve spring 68 engages the valve guide 52 and the valve stem 42 to ensure that the valve element 40 is normally closed, and opens only when actuated to permit flow therethrough.

The transfer valve assembly 10 further includes a valve train subassembly 80. The valve train subassembly 80 has a second spring means or train spring 82. The train spring 82 engages an annular downwardly-facing first train spring support shoulder 90 at the upper end of a recess defined in the lower face of the exterior housing 24 of the engine 20 by a cylindrical recess surface 92. The axes of the train spring 82 and the first train spring support shoulder 90 are co-axial with the axis of the valve element 40.

Preferably, both the valve spring 68 and the train spring 82 are cylindrical helical springs, which are compressed when in place. Absent any actuating force, the valve spring 68 maintains the desired separation of the first spring support collar 62 and the second spring support collar 74, while the train spring 82 maintains a selected separation of the actuation transfer element base 102 from the first train spring support shoulder 90.

A valve actuation transfer element 100 engages the train spring 82. The valve actuation transfer element 100 includes a generally planar, disc-shaped transfer element base portion 102 and a generally tubular transfer element sidewall 104 extending upwardly from the outer edge of the transfer element base 102. The transfer element sidewall 104 is co-axial with and extends peripherally about the exterior of the train spring 82, which in turn extends peripherally about the exterior of the valve spring 68. The sidewall exterior surface 106 slidingly engages the cylindrical recess surface 92, which engagement guides the valve actuation transfer element 100 to minimize axial deviation during movement thereof and serves to seal the transfer valve assembly 10 against dirt and other contaminants which might otherwise enter the external housing 24. Also, because the valve assembly 10 is employed herein as a transfer valve between the interior housing 22 and the exterior housing 24, the valve actuation transfer element 100 prevents exhaust gases from escaping the external housing. In operation, the train spring 82 extends between the first train spring support shoulder 90 and the transfer element 100 to maintain the transfer element 100 in the non-actuating position.

The transfer element 100 further includes a means for engaging a valve actuator mechanism. Preferably, the means for engaging the actuator mechanism is a downwardly extending valve train actuator shaft 108 having an actuator shaft distal end 110 which engages a rocker arm 112 of the valve actuating means 114. Those skilled in the relevant art will understand the described valve actuating means 114 to be a camshaft-driven, push-rod type valve actuating means 114, and that other valve actuating means 114, such as a direct cam operated valve actuating means may be employed with equal success. The valve actuating means 114 does not itself comprise the subject invention.

Figure 2C:
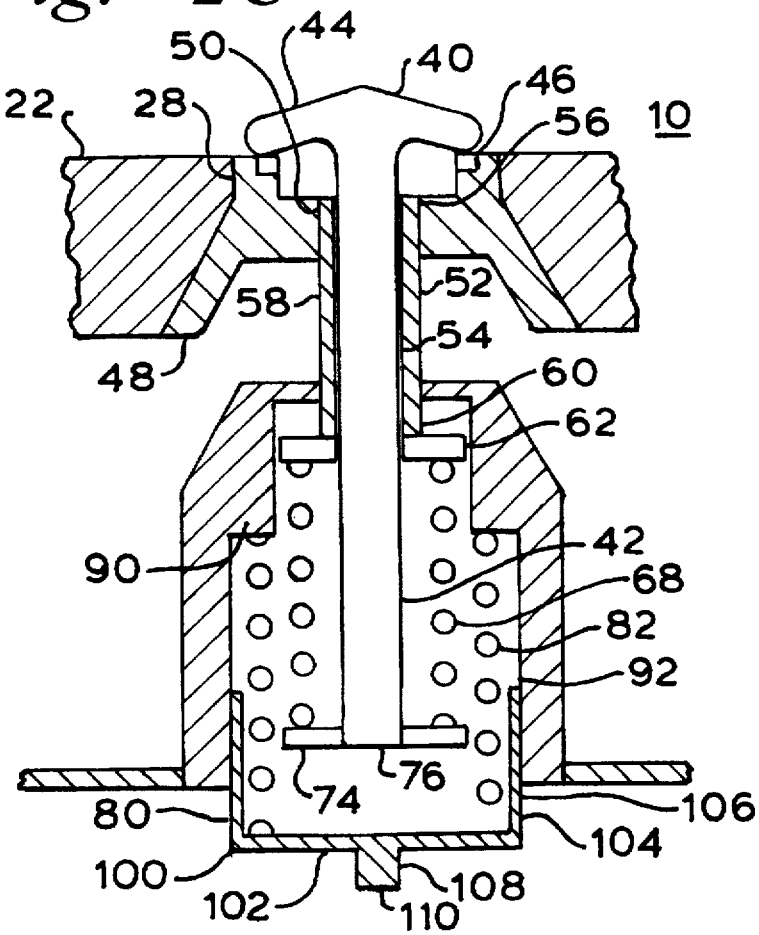
FIGS. 2A, 2B and 2C show a cross-sectional view the valve assembly according to FIG. 1 at various degrees of crankshaft rotation.
Figure 2A:
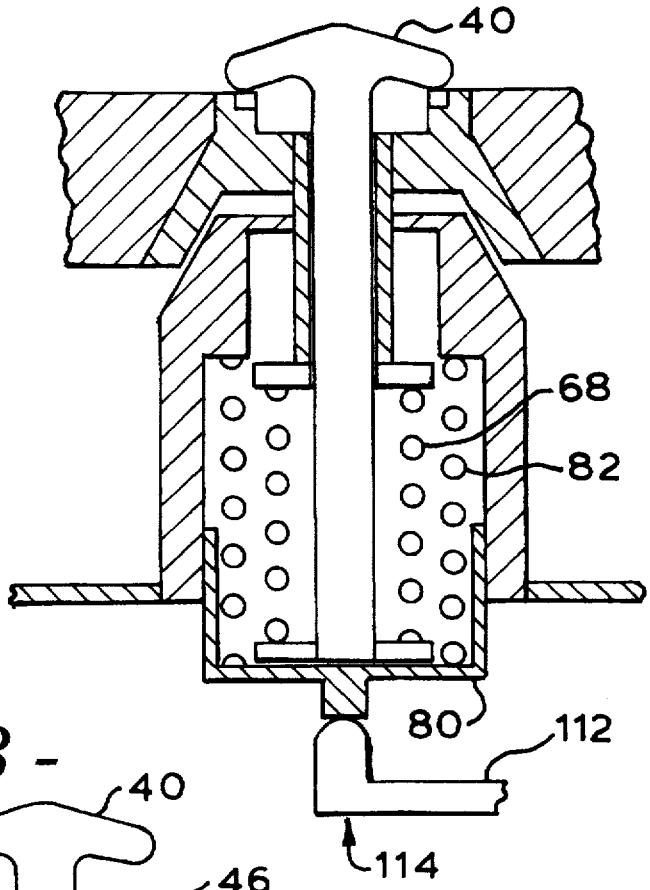
Figure 2B:
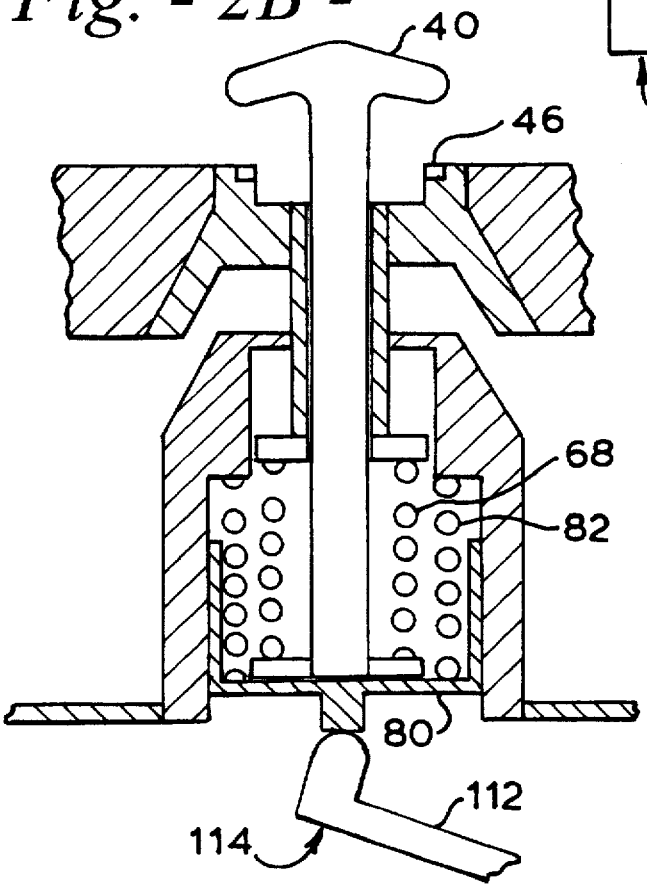

Referring more particularly to FIGS. 2A, 2B and 2C, the operation of the valve assembly 10 can be more readily understood. In FIG. 2A, the internal housing 22 has moved to the fully downward position and no actuating force has been applied by the rocker arm 114 to the actuator shaft distal end 110. As the valve spring 68 acts against the second spring support shoulder 72 and upon the valve stem distal end 76, the valve element 40 is forced downward such that the head 44 engages the valve seat 46.

In FIG. 2B, the internal housing 22 is moving upward with respect to the external housing 24, and the rocker arm 112 has been moved to apply an actuator force to the actuator shaft distal end 110. This forces the valve actuator transfer element 100 upward against the resistive force applied by the train spring 82. The transfer element base portion 102 is thus brought into contact with the valve stem 42, overcoming the valve spring 68 and forcing the valve element 40 upward in the valve guide 52 and causing the head 44 to disengage the valve seat 46, in turn permitting flow through the valve assembly 10.

FIG. 2C shows the valve assembly 10 after the actuation has ceased. The rocker arm 112 is returned to the neutral, non-actuating position, and the internal housing has moved to the fully upward position. At this point, the valve spring 68 again has brought the valve element 40 downward in the valve guide 52 to the closed position, with the head 44 seating on the valve seat 46. The train spring 82 has also returned the valve actuation transfer element 100 to its normal, non-actuating position, with the shaft 110 resting on the rocker arm 112. The valve element 40 has been carried upward with the internal housing 22, while the valve train subassembly 80 remains with the external housing 24.

This permits the rocker arm 112, and thus the valve actuating means, to operate with substantially less displacement, since the valve actuating means need only provide sufficient displacement to actuate the valve assembly 10 at the desired time. Another advantage provided by the subject invention is that the valve actuation means need not follow the displacement of the valve element 40 in relation to the external housing 24 during the non-actuation portions of engine operation, and the rocker arm need not be displaced at all. Typically, where a cam is used to provide actuation of the valve assembly 10, the subject invention permits the use of a cam having a substantially smaller base circle, and substantially reduces the forces and accelerations which the cam follower. This reduces maintenance requirements and enhances the longevity of the engine in which the subject invention is employed. Reducing the displacement required by the rocker arm 112 also permits a substantial reduction in the size of the rocker arm 112, and of the overall size of the engine 20, which reduces in turn the cost of manufacture of an engine 20 employing the subject invention. Therefore, the subject invention has several important advantages over the prior art.

The transfer valve assembly 10 is also applicable to and useful in other engine configurations. For example, the transfer valve assembly 10 may be employed in the typical valve-in-head internal combustion engine in cases where it is desirable to ensure that the valve train subassembly 80 is in continuous contact with the valve actuating means 114. Therefore, while the transfer valve assembly 10 may be most conveniently understood in connection with described engine 20, it should be likewise understood that it is not limited to that particular application.

Modifications to the preferred embodiment of the subject invention will be apparent to those skilled in the art within the scope of the claims that follow:

I claim:

1. A valve assembly for selectively permitting and preventing fluid flow in an engine, said valve assembly comprised of:

a valve element having a valve stem and a valve head;

a valve guide in sliding engagement with said valve stem for directing motion of the valve stem;

a spring means engaging said valve stem and said valve guide for ensuring that said valve element is normally closed;

a valve train subassembly responsively contacting a valve actuating means of said engine to transfer an actuation force from said valve actuation means to said valve element when said valve actuating means actuates said valve assembly, said valve train subassembly including a valve actuation transfer element, said valve actuation transfer element having a generally tubular transfer element sidewall including a generally cylindrical sidewall exterior surface, said sidewall exterior surface slidingly engaging a cylindrical recess surface in said engine, and said valve actuation transfer element further including a transfer element base portion having a valve train actuator shaft extending distally therefrom; and a second spring means for maintaining said valve train subassembly in a non-actuating position.

2. The valve assembly as set forth in claim 1 wherein said valve train actuator shaft further includes an actuator shaft distal end in responsive contact with said valve actuating means.

3. The valve assembly as set forth in claim 2 wherein said valve guide is secured to a guide support bridge in said engine.

4. The valve assembly as set forth in claim 3 wherein said valve guide further includes a valve guide anterior end secured to said guide support bridge, and a valve guide distal end.

5. The valve assembly as set forth in claim 4 wherein said valve assembly further includes a valve spring first support collar secured to said valve guide distal end.

6. The valve assembly as set forth in claim 5 wherein said valve assembly further includes a valve spring second support collar secured to a distal end of said valve element.

7. The valve assembly as set forth in claim 6 wherein said first support collar further includes an annular first spring support shoulder.

8. The valve assembly as set forth in claim 7 wherein said second support collar further includes an annular second spring support shoulder.

9. The valve assembly as set forth in claim 8 wherein said first spring means extends from said first spring support shoulder to said second spring support shoulder.

10. A valve assembly for selectively permitting and preventing fluid flow in a dual compression/dual expansion internal combustion engine having an internal housing operably disposed in an external housing, said valve assembly comprised of:

a valve element communicating through a port surface in said internal housing, said valve element having a generally cylindrical valve stem and a valve head for selectively permitting and preventing flow through the aperture defined by said port surface;

a generally tubular valve guide having a cylindrical valve guide inner surface in sliding engagement with said valve stem for directing linear motion of the valve stem;

a valve train subassembly communicating through and slidingly engaging a cylindrical recess surface in said external housing, said valve train subassembly responsively contacting a valve actuating means of said engine to transfer an actuation force from said valve actuation means to said valve element when said valve actuating means actuates said valve assembly, said valve train subassembly further including a second spring means for maintaining the valve train subassembly in a normally non-actuating condition.

11. The valve assembly as set forth in claim 10 wherein said valve guide is secured to a guide support bridge in the internal housing of said engine, said guide support bridge extending across the aperture defined by said port surface.

12. The valve assembly as set forth in claim 11 wherein said valve guide further includes a valve guide anterior end secured to said guide support bridge, and a valve guide distal end.

13. The valve assembly as set forth in claim 12 wherein said valve assembly further includes a valve spring first support collar secured to said valve guide distal end.

14. The valve assembly as set forth in claim 13 wherein said valve assembly further includes a valve spring second support collar secured to a distal end of said valve element.

15. The valve assembly as set forth in claim 14 wherein said first spring means extends from said first spring support collar to said second spring support collar.

16. The valve assembly as set forth in claim 15 wherein said first spring means is a cylindrical helical spring.

17. The valve assembly as set forth in claim 16 wherein said valve actuation transfer element further includes a transfer element base portion.

18. The valve assembly as set forth in claim 17 wherein said transfer element base portion further includes a valve train actuator shaft extending distally therefrom.

19. The valve assembly as set forth in claim 18 wherein said valve train actuator shaft further includes a actuator shaft distal end in responsive contact with said valve actuating means.

20. The valve assembly as set forth in claim 19 wherein said second spring means is a cylindrical helical spring.

21. The valve assembly as set forth in claim 19 wherein said second spring means is coaxial with and extends peripherally about said first spring means.

22. The valve assembly as set forth in claim 21 wherein said second spring means extends from said transfer element base portion to a third spring support shoulder.

* * * * *